United States Patent [19]

Lindsay

[11] Patent Number: 4,730,582

[45] Date of Patent: Mar. 15, 1988

[54] PERFORMING SPARK PLUG

[76] Inventor: Maurice E. Lindsay, 114 Standard St., El Segundo, Calif. 90245

[21] Appl. No.: 941,710

[22] Filed: Dec. 15, 1986

[51] Int. Cl.[4] ..... F02P 15/08; H01T 13/32

[52] U.S. Cl. ..... 123/169 MG; 123/169 EL; 313/130; 313/143

[58] Field of Search .... 123/169 EL, 169 G, 169 MG, 123/266; 313/130, 131 R, 140, 141, 143

[56] References Cited

U.S. PATENT DOCUMENTS

| | | | |
|---|---|---|---|
| 2,164,311 | 7/1939 | Doran | 123/169 MG |
| 4,092,558 | 5/1978 | Yamada | 313/131 R |
| 4,194,486 | 3/1980 | Satow et al. | 123/169 EL |
| 4,307,316 | 12/1981 | McKechnie | 313/143 |
| 4,439,707 | 3/1984 | Hattori et al. | 313/130 |
| 4,476,412 | 10/1984 | Nishida et al. | 313/130 |
| 4,487,177 | 12/1984 | Ishikawa | 123/169 MG |

*Primary Examiner*—Willis R. Wolfe, Jr.
*Attorney, Agent, or Firm*—Jack C. Munro

[57] ABSTRACT

A spark plug for an internal combustion engine which utilizes an annular round ring surrounding the center electrode. Surrounding the center electrode is a fire hole which includes an enlarged annular space to achieve an increased volume of the fire hole to maximize the ignition of the fuel/air mixture within the fire hole. The ground ring may include a series of ports to facilitate dispersement from the spark plug of the ignited fuel/air mixture within the fire hole.

5 Claims, 12 Drawing Figures

PERFORMING SPARK PLUG

BACKGROUND OF THE INVENTION

The field of this invention relates to an improved spark plug for an internal combustion engine and more particularly to a spark plug which produces a substantially increased operating efficiency of the internal combustion engine.

Spark plugs are used in most internal combustion engines (except diesel engines) to provide high voltage sparks which ignite the fuel/air mixture within the combustion chambers of the engine. When the engine is running, a pulse of electrical energy, at very high voltage, is delivered to the terminal of the spark plug at the correct moment by means of a distributor. A spark is caused to jump the gap between the center electrode an the ground electrode, the latter being earthed to the cylinder block of the engine. This spark provides the energy needed to ignite the compressed fuel/air mixture in the cylinder of the engine.

It has been found that, for optimum performance, the temperature of the core nose at the firing end of a spark plug should not drop below four hundred degrees centigrade nor exceed about eight hundred fifty degrees centigrade. Below four hundred degrees centigrade, deposits of carbon and oil are likely to accumulate. Carbon being electrically conductive, can provide a short circuit path for the high voltage pulse and so weaken or eliminate the spark. Core nose temperatures of above eight hundred degrees centigrade can cause excessive electrode erosion and possibly uncontrolled ignition of the fuel/air mixture in advance of the timed spark. This condition (called pre-ignition) can cause serious engine damage.

In recent years there has been an enormous increase in the use of spark plugs on which the core nose projects beyond the end of the threaded body. Generally, the extra-long core nose runs hotter than other types of spark plugs at low engine speeds giving improved protection against plug fouling. At high engine speeds, the exposed core nose is cooled by the incoming fuel/air mixture, thus avoiding the risk of plug overheating.

The conventional type of spark plug utilizes a strip-type of ground electrode which overlies the tip of the center electrode. This strip assumes a slight gap from the center electrode across which the spark is to occur. This type of spark plug has but one spark presentation, that being that the spark occurs at approximately the same location each time the spark plug is operated. Any accumulations of oil or carbon, not located directly in the path of the firing of the spark plug, will remain adhered to the surface of the spark plug and will accumulate and result in inefficient usage of the spark plug.

Spark plug bodies are generally made of high quality steel and are zinc plated to avoid corrosion. The insulators, which surround the center electrode, are made from a fired aluminum oxide ceramic material which is highly resistant to thermo and mechanical stress and chemical attack. The center electrodes are most commonly made from nickel alloys, but precious metals sometimes are used. Gas tight seals are required between the center electrode and insulator and also between the insulator and housing. These seals are normally formed from aluminum oxide powder (termed sillment) which when compressed becomes a rigid mass which fits the available space exactly.

In this day and age in which exhaust emissions are closely controlled, there is a need to construct a spark plug which causes the fuel/air mixture of the engine to burn more completely and evenly thereby decreasing the amount of pollutants created during combustion.

SUMMARY OF THE INVENTION

The primary objective of the present invention is to construct a spark plug which achieves a more complete even burning of the fuel/air mixture which the combustion chamber and in doing so produces a substantially lesser amount of pollutants being exhausted into the atmosphere while at the same time increasing the power output of the engine.

The spark plug of the present invention is constructed similar to a conventional spark plug in that it has a housing within which is located a center electrode. Mounted on the center electrode is an insulator. The inner end of the center electrode terminates in a tip. The portion of the insulator directly adjacent to this tip is termed the core nose. This core nose is mounted within a fire hole which constitutes an annular space between the core nose and the housing of the plug. There is an exit opening of the fire hole located directly adjacent to the tip of the center electrode. The wall of this exit opening functions as an annular electrode surface to which the spark is to jump from the center electrode. The fire hole includes an enlarged annular space to maximize the volume of the fire hole. The housing of the plug, in the area of the fire hole, is termed a ground ring. This ground ring may include a series of ports. Ignited streams of the fuel/air mixture from the fire hole are to be propelled through these ports to be dispersed throughout the combustion chamber of the engine within which the spark plug has been mounted.

Another objective of the present invention is to construct a spark plug which achieves multiple spark presentations so that the spark traverses multiple paths in operation of the spark plug as opposed to traversing a single path.

Another objective of the present invention is to construct a spark plug that includes a self-cleaning feature ionizing the accumulation of the products of combustion that may be inclined to adhere to surfaces of the core nose of the spark plug.

Another objective of the present invention is to construct a spark plug which produces a substantially increased area of spark exposure to the combustible mixture than conventional spark plugs which therefore causes a more complete combustion to occur.

Another objective of the present invention is to construct a spark plug which can be manufactured at a cost substantially equal to the manufacturing of a conventional spark plug.

DETAILED DESCRIPTION OF THE SHOWN EMBODIMENT

Figure 1:
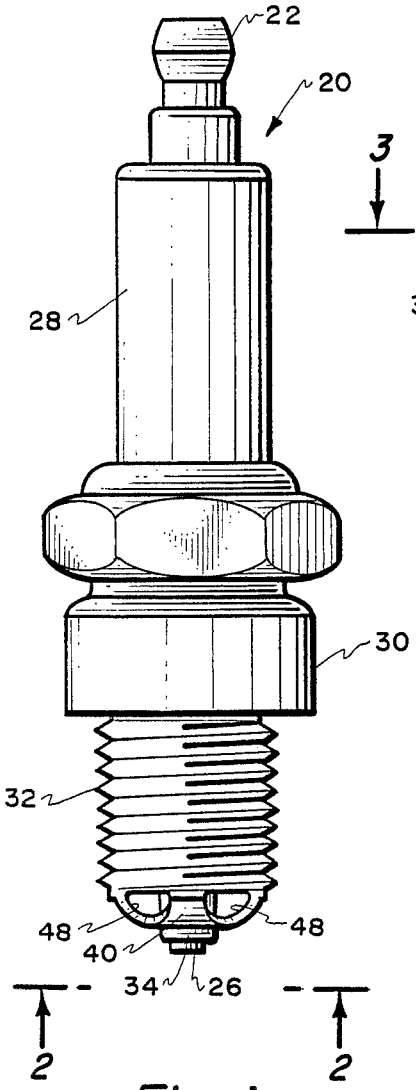
FIG. 1 is a side elevational view of a first embodiment of the spark plug of this invention.
Figure 2:
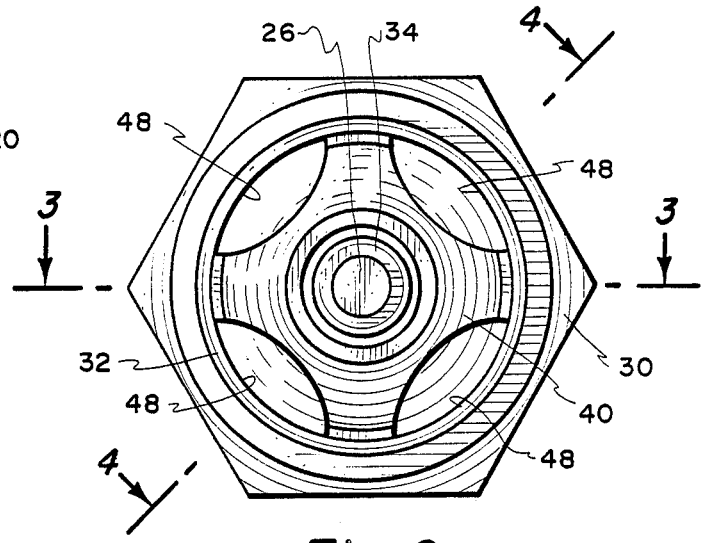
FIG. 2 is a bottom plan view taken along line 2—2 of FIG. 1.

The spark plug of the present invention utilizes a unique configuration to provide a true self-cleaning spark path which completely eliminates the possibility of ceramic failure due to electrical penetration of the ceramic. The new "high potential" ignition systems has made it possible to develop entirely new types of spark plugs with much higher voltage requirements. Included within these "high potential" ignition systems is a new high efficiency spark plug cable which enables a much higher current flow to provide greater heat in the spark path. The spark plug of the present invention achieves extremely high efficiency at a constant level with no significant performance decline. When incorporated within an automobile, acceleration of the automobile and smooth power flow has been achieved in all driving modes.

Referring particularly to the drawings, there is shown in FIGS. 1-4 the first embodiment 20 of the spark plug of this invention. The plug 20 has an outer end which is formed into a terminal 22. The terminal 22 is electrically connected to the center electrode 24. Normally the center electrode 24 will be cylindrical in transverse cross-section. The center electrode 24 terminates in a tip 26 at the firing end of the spark plug 20.

Fixedly mounted onto the center electrode 24 is an insulator 28. Fixedly mounted onto the exterior wall of the insulator 28 is a housing 30. Located between insulator 28 and the housing 30 is a gas tight seal 46. The use of such seals 46 is deemed to be conventional within spark plug construction. A portion of the exterior surface of the housing 30 includes a series of screw threads 32. The portion of the insulator 28 that is closest to the tip 26 is defined as a core nose 34. A chamber is formed within the housing 30 which is to be referred to as a fire hole 36. The basic configuration of the fire hole 36 is annular in respect to the insulator 34. The portion of the fire hole 36 that is located nearest the tip 26 is enlarged forming enlarged space 38.

The portion of the housing 30 that is located nearest the tip 26 is formed into an enclosing configuration with respect to the fire hole 36. This portion of the housing is termed a ground ring 40. The center electrode 24 and the core nose 34 extend through an exit opening 42. The exit opening 42 defines a sharpened annular edge 44. It is to be noted that the sharpened edge 44 is located at the exterior wall surface of the ground ring 40.

The ground ring 40 has formed therein a series of ports 48 with four in number being shown. It is to be understood that this number can be increased or decreased without departing from the scope of this invention. Each of the ports 48 connect with the enlarged space 38. The function of the ports 48 will be explained further on in this specification.

Figure 3:
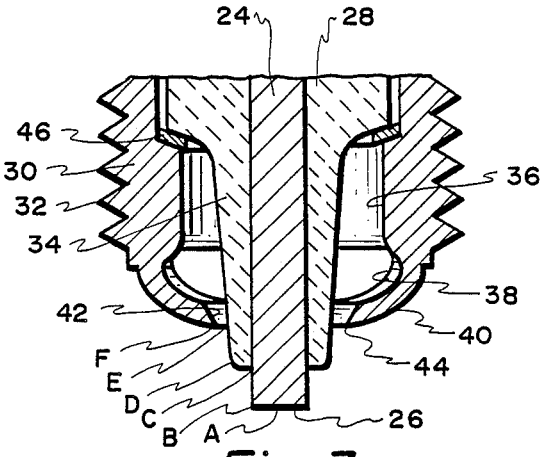
FIG. 3 is a cross-sectional view through the firing end of the spark plug of FIG. 1 taken along line 3—3 of FIG. 2.
Figure 4:
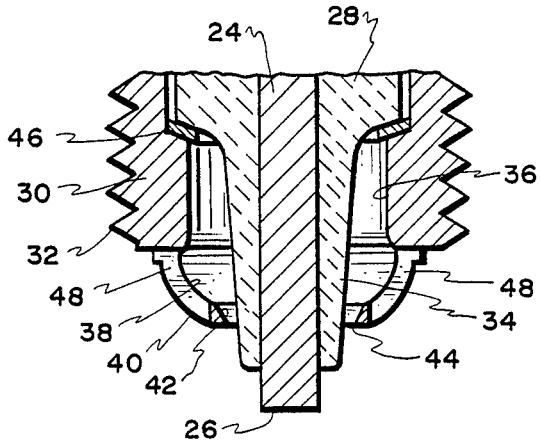
FIG. 4 is a cross-sectional view, again through the firing end of the spark plug of FIG. 1, taken along line 4—4 of FIG. 2.
Figure 5:
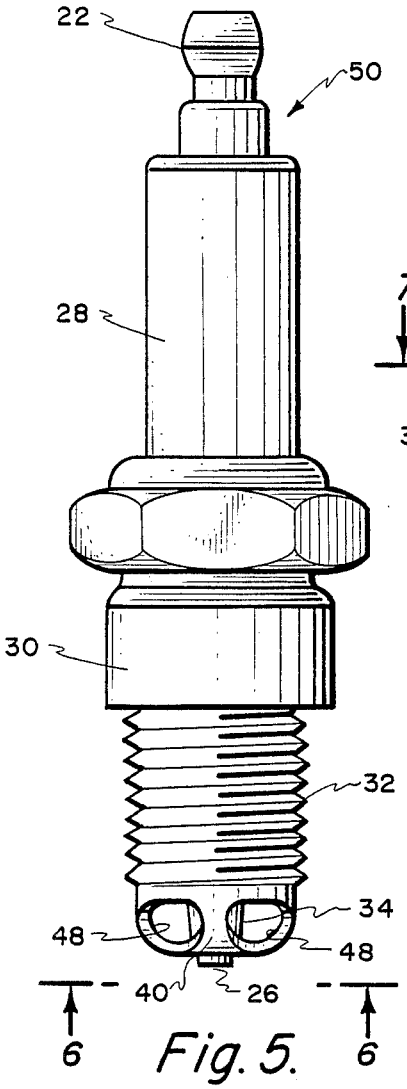
FIG. 5 is a side elevational view of the second embodiment of the spark plug of this invention.
Figure 6:
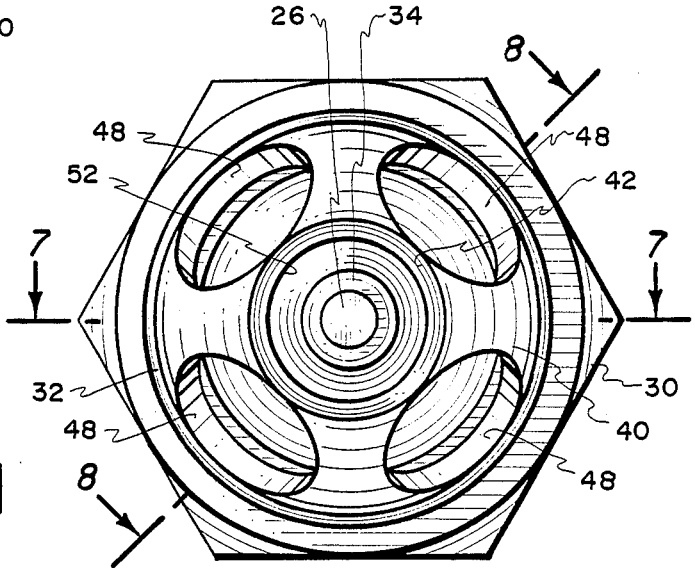
FIG. 6 is a bottom plan view taken along line 6—6 of FIG. 5.

In referring to FIGS. 3 and 4 of the drawings, it can thus be seen that the core nose 34 extends completely through and exteriorly of the exit opening 42. The tip 26 of the center electrode 24 is located protruding from the outer edge of the core nose 34. This protrusion of the center electrode 24 and the core nose 34 is desirable within certain installations. During combustion the spark that is conducted through the center electrode 24 does not exit tip 26 at point "A" (FIG. 3) of the tip 26 but exits at point C. Point C is actually a circle. The spark then travels across the surface of the core nose 34 to point D (which is also a circle). From point D the spark will progress along the surface of the core nose 34 toward point E. The spark will then jump the air gap to point F. During periods of deceleration, the spark will progress from C to D to point F making an umbrella configuration. Point F comprises a sharpened annular edge 44.

If any foreign material collects on the exterior surface of the core nose 34, the spark will have the tendency to follow the path of least resistance and ionize and remove the deposit immediately. This removal occurs during acceleration and normal cruise of the vehicle. Such deposits would normally take place in starting and idling modes of the vehicle. In the accelerating mode the spark will, if any accumulation of extraneous material has occurred, at times move entirely along the surface of the core nose 34 as far as the gas tight seal 46. As a result, during the normal different modes of operation that occur in the operation of a motor vehicle, the spark path will tend to ionize any collection of any oil or carbon on the entire exterior surface of the core nose 34 and also the firing surfaces of the ground ring 40 as well as the wall of the fire hole 36.

It is to be noted that if one could observe the firing of the spark plug 20 that there will be a mass of what appears to be continuous firings in all different directions (three hundred sixty degrees) from circular point C from the tip 26. This means that, with the spark plug 20 of this invention, there are multiple spark presentations and not a single spark presentation which is so prevalent within prior art spark plugs.

A still further advantage of the spark plug 20 of this invention is that the spark must travel on the core nose 34 thereby ionizing any accumulation of carbon, fuel or oil and products of combustion in the process of the igniting of the fuel/air mixture. Prior to firing of the spark plug, the fuel/air mixture engulfs the fire hole 36. The size of the fire hole 36 has been increased by enlarged annular space 38 which means the volume of the fuel/air mixture contained within the fire hole 36 is also increased. Igniting of this fuel/air mixture produces ignited streams shooting out of each of the ports 48. These streams act to ignite the fuel/air mixture contained within the combustion chamber of the engine in all areas of that combustion chamber. Therefore, complete burning occurs and maximum power output is obtained from the burning of the fuel/air mixture. Fuel igniting also occurs around the portion of the core nose 34 that extends exteriorly of the fire hole 36. Because the fuel/air mixture is completely burned, a minimal amount of pollutants are produced in the burning of the fuel/air mixture.

Referring particularly to FIGS. 5–8 of the drawings, there is shown a second embodiment 50 of the spark plug of this invention. Like numerals have been utilized to refer to like parts from FIGS. 1–4. The difference in the spark plug 50 is that only the tip 26 of the center electrode 24 protrudes exteriorly of the exit opening 42. The core nose 34 is located entirely within the confines of the fire hole 36. The exit opening 42 includes a sharpened edge 52. It is to be noted that the sharpened edge 52 is formed on the inside wall surface of the ground ring 40.

The firing of the plug 50 during acceleration and cruise will be directly from point D to E and across the air gap to F. During acceleration, the spark may traverse again down the wall surface of the core nose 34, even as far as the gas tight seal 46. During deceleration, the spark will initiate either at points B or C and jump directly to point F.

Figure 7:
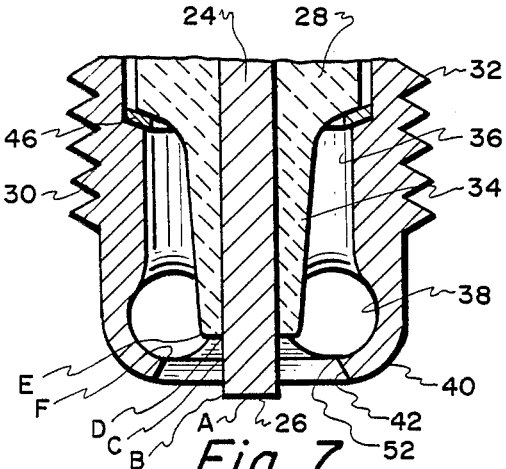
FIG. 7 is a cross-sectional view through the firing end of the spark plug of FIG. 5 taken along line 7—7 of FIG. 6.
Figure 8:
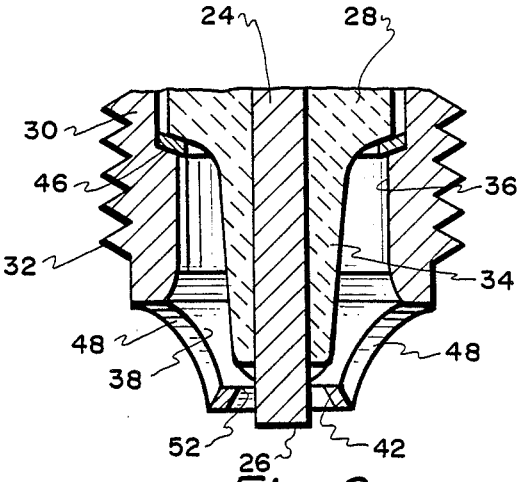
FIG. 8 is a cross-sectional view, again through the firing end of the spark plug of FIG. 5, taken along line 8—8 of FIG. 6.
Figure 9:
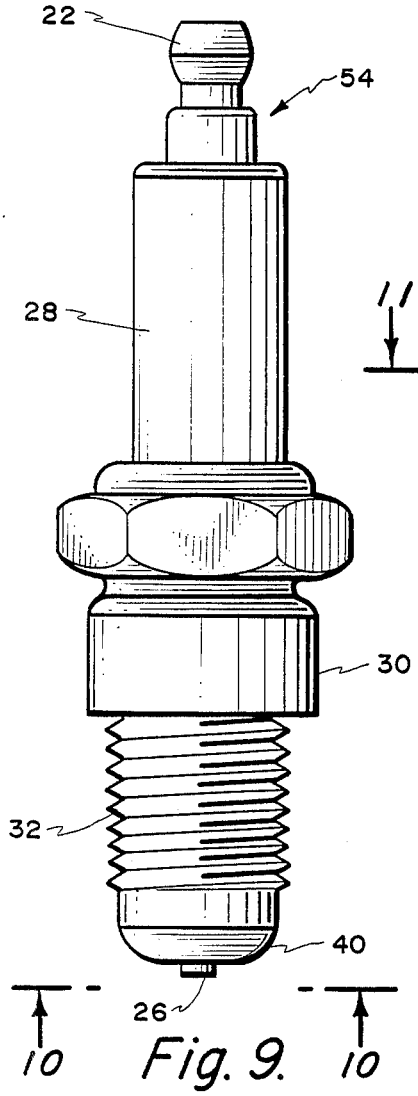
FIG. 9 is a side elevational view of a third embodiment of the spark plug of this invention.
Figure 10:
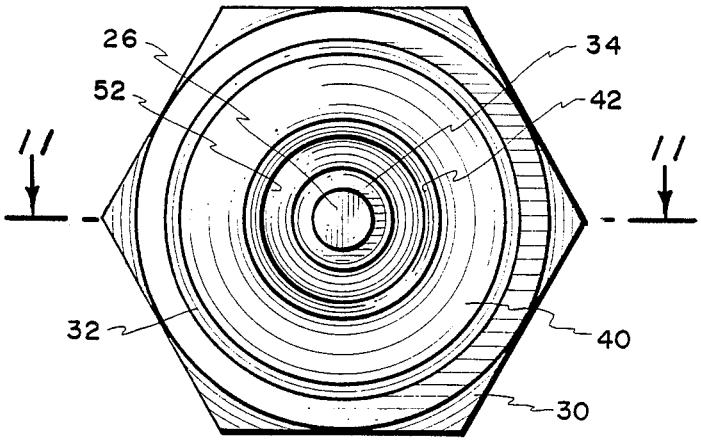
FIG. 10 is a bottom plan view taken along line 10—10 of FIG. 9.
Figure 11:
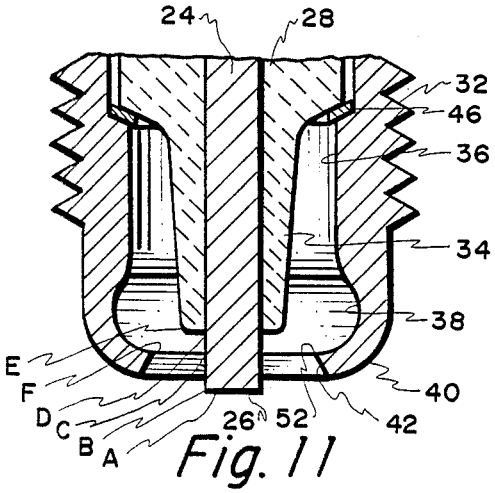
FIG. 11 is a cross-sectional view through the firing end of the spark plug of FIG. 9 taken along line 11—11 of FIG. 10.
Figure 12:
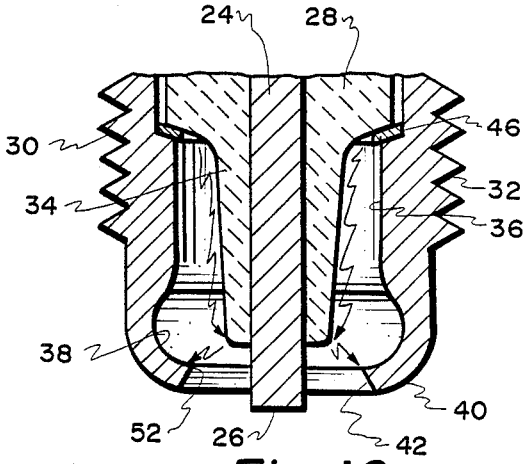
FIG. 12 is a view, similar to FIG. 11, depicting the movement of the spark.

It is to be noted that within FIGS. 7 and 8 it is important that the tip of the core nose 34 be spaced a certain distance from point C. In actual practice a desirable distance would be approximately thirty thousandths of an inch for certain configurations of the spark plug 50. A good rule of thumb would be that if a line were drawn from point E to point F, that line would assume a thirty to forty-five degree angle with the longitudinal center axis of the center electrode 24.

Referring particularly to FIGS. 9–12 of the drawings, there is shown a third embodiment 54 of the spark plug of this invention. Again, like numerals have been utilized to refer to like parts.

The difference of the spark plug 54 versus that of spark plug 50 has to do with the eliminating of ports 48. Again, in certain installations, the elimination of the ports 48 may be preferred. Propagation of the ignited gases from the fire hole 36 (including enlarged spaced 38) would be through the exit opening 42. It is to be noted that the sharpened edge 52 (point F) is again formed at the inner wall surface of the ground ring 40. The firing sequence in most instances (acceleration and cruise) would be from D to E then across the air gap to F. During deceleration the firing sequence will occur directly from point C to point F or from B to F. Still further, the spark at times during acceleration and cruise will be conducted along the exterior surface of the core nose 34, to remove any deposit, as is depicted within FIG. 12. During deceleration there is no tendency for the spark to travel along the exterior surface of the core nose 34.

What is claimed is:

1. A spark plug for producing combustion within the combustion chamber of an internal combustion engine, said spark plug comprising:

an elongated housing terminating in an electrical ground ring at one end, said housing being tubular forming an internal chamber, said ground ring defining an enclosing exit opening;

a center electrode mounted within said internal chamber, said center electrode having a tip, said center electrode located within said exit opening with said tip being located exteriorly of said exit opening;

an insulator mounted on said electrode, said insulator terminating in a core nose directly adjacent to said tip, said exit opening being larger than said insulator;

a fire hole formed within said internal chamber, said fire hole located directly adjacent said exit opening, said fire hole defining an annular space between said insulator and said ground ring, whereby said annular space functions as a precombustion chamber which is to propel an ignited fuel/air mixture exteriorly of said fire hole into the combustion chamber of the internal combustion engine; and said ground ring including a series of ports, each said port connecting with said annular space of said fire hole, each said port being totally enclosed by said ground ring, whereby ignited fuel/air mixture is to be propelled through said ports into the combustion chamber of the internal combustion engine to facilitate even and complete burning of the fuel/air mixture within the combustion chamber, each said port is to direct a separate stream of ignited fuel/air mixture at a different direction into the combustion chamber to insure even distribution of the ignited fuel/air mixture within the combustion chamber.

2. The spark plug as defined in claim 1 wherein:

said exit opening having an annular edge, said annular edge being sharpened.

3. The spark plug as defined in claim 2 wherein:

said sharpened annular edge being located at the interior wall surface of said exit opening.

4. The spark plug as defined in claim 2 wherein:

said sharpened annular edge being located at the exterior wall surface of said exit opening.

5. The spark plug as defined in claim 1 wherein:

said annular space including an enlarged section, said enlarged section being located directly adjacent said ports, said enlarged section increasing the volume of said annular space thereby increasing the amount of ignited fuel/air mixture within said precombustion chamber to maximize the length of the propelled jets of ignited fuel/air mixture from said ports into the combustion chamber.

* * * * *